US005424928A

United States Patent [19]

Jordan et al.

[11] Patent Number: 5,424,928

[45] Date of Patent: Jun. 13, 1995

[54] LANTERN

[75] Inventors: Guntram Jordan, Mammoth Lakes; Peter C. Benjamin, Santa Barbara, both of Calif.

[73] Assignee: Northern Lights, Inc., Mammoth Lakes, Calif.

[21] Appl. No.: 76,256

[22] Filed: Jun. 10, 1993

[51] Int. Cl.[6] ..... F21L 19/00

[52] U.S. Cl. ..... 362/162; 362/163; 362/180; 362/314

[58] Field of Search ..... 362/162, 163, 180, 181, 362/182, 314, 315, 316

[56] References Cited

U.S. PATENT DOCUMENTS

| | | | |
|---|---|---|---|
| 1,380,728 | 6/1921 | Meyer | 362/314 |
| 1,632,577 | 6/1927 | Anderson | 362/180 X |
| 4,186,430 | 1/1980 | Britton | 362/162 |
| 4,520,431 | 5/1985 | Fanelli et al. | 362/180 |
| 4,566,055 | 1/1986 | Klees et al. | 362/162 |
| 4,646,213 | 2/1987 | Fanelli et al. | 362/180 |
| 4,926,297 | 5/1990 | Masters et al. | 362/162 |

*Primary Examiner*—Stephen F. Husar
*Attorney, Agent, or Firm*—Merchant, Gould, Smith, Edell, Welter & Schmidt

[57] ABSTRACT

A collapsible lantern includes a housing and a chimney telescopically moveable within the housing between a retracted and an extended position. The chimney includes a ring at the top and the bottom made of a high temperature-resistant thermoplastic which is adhesively affixed to the transparent chimney with a thixotropic paste. The transparency about the chimney is unimpeded by elongated retaining elements to hold the rings with the tubular transparent chimney. The chimney can be selectively extended, retracted or interlocked or released from the housing by interacting features on the lower ring and the internal surface of the housing.

22 Claims, 2 Drawing Sheets

LANTERN

BACKGROUND

Providing a lantern with the ability to shed light evenly and without impeding retaining clips securing a chimney to a housing generating the light is valuable.

This invention relates to lanterns. In particular, the invention is concerned with collapsible lanterns suitable for outdoor usage or for fulfilling temporary need, indoors or outdoors.

It is known to have such lanterns where a chimney extends above a housing. The chimney can collapse with the housing. At an extended position the chimney can extend beyond the housing. Currently, all known lanterns of this fashion have elongated retaining elements extending up the length of the chimney for the purpose of securing the chimney with the housing. These elements impede the light emanating from the chimney.

There is a need to provide a lantern having improved characteristics of light emanation from the chimney.

SUMMARY

By this invention, there is provided a lantern with a chimney having improved light emanation, namely light emanating without obstructing elongated retaining elements directed over the transparent portion of the chimney.

According to the invention, there is provided a lantern having a housing with an upper end and a lower end. A chimney telescopically moves within the housing. The chimney is constituted by a transparent element with a lower ring and an upper ring. Rings about the chimney are made of a high temperature resistant thermoplastic, namely a polypropylene sulfide. A single component thixotropic adhesive paste suitable for high temperatures is used to affix the rings with the transparent chimney.

The lower ring engages the housing such that the chimney can be selectively locked in a retracted position, an extended position, or be removed from the housing as necessary.

The chimney includes an upper ring to which is affixed a pivotable bail to facilitate hanging of the lantern when the chimney is extended and the bail extends upwardly from the chimney. When the chimney is retracted and the bail extends downwardly, it locks the chimney with the housing.

The invention is further described with reference to the accompanying drawings.

DRAWINGS

DESCRIPTION

Figure 1:
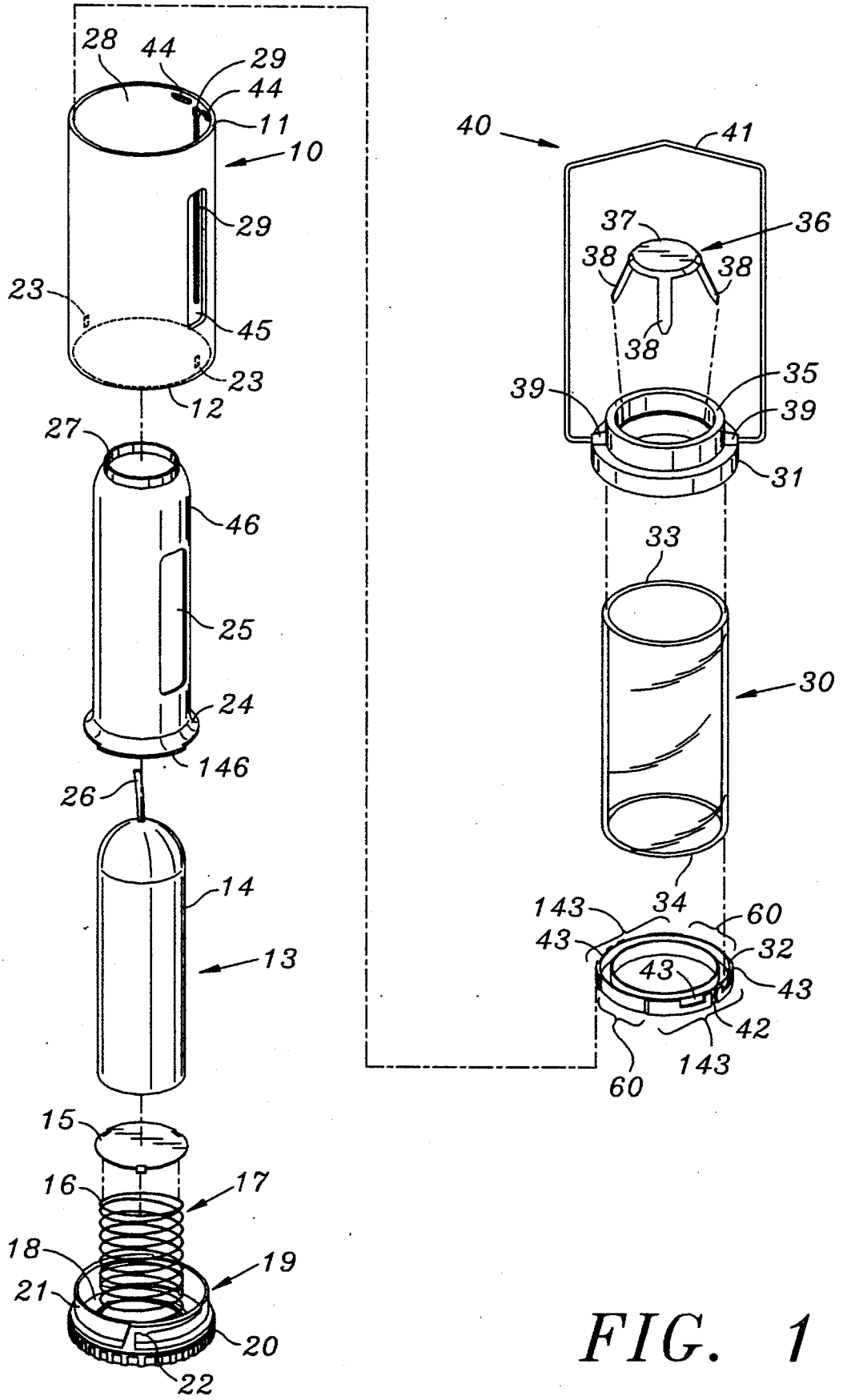
FIG. 1 is an exploded perspective view of a lantern.

A collapsible lantern comprises a tubular housing 10 having an upper end position 11 and a lower end position 12. A light source 13 is contained in the housing 10.

The light source 13 includes a candle 14 mounted within an aluminum tubular candle holder 46.

The candle 14 is located on a circular disk or piston 15 which is mounted on a helical feed spring 16 with the top end 17 of the helical spring 16 interacting under the disk 15. The bottom portion 18 of the helical spring 16 is mounted against a base 19. The base includes a circumferential finger grip section 20 and an upstanding ridge 21. This facilitates rotation of the base 29. On the ridge 21 there is located a protrusion 22 for engagement with protrusions 23 which are diametrically oppositely located at the lower end portion 12 of the tubular housing 10.

The candle holder 46 includes a flanged portion 24 which fits within the ridged section 21 of the cap 19. A slot 124 circumferentially directed partially about the base 20 adjacent the bottom engages a tab 146 at the free end of flange 24. A slot 25 in the candle holder 15 is a viewing aperture through which the remaining length of the candle 14 can be determined. The helical spring urges the candle 14 upwardly so that a wick 26 protrudes from the aperture 27 of the candle holder 46 to provide an effective light source 13.

The tubular housing 10 is formed of a thermoplastic material, namely Zytel (a Trademark of G.E.). The thermoplastic material of the housing 10 is about 40% glass fiber. It includes an elongated slot 27 designed to align with slot 25 so that viewing of the candle 14 can be seen through both the candle housing 15 and the tubular housing 10. Inside the tubular housing 10 on the inside wall 28, there is provided an elongated ridge 29 which extended essentially from the top of the housing 10 towards a position short of the bottom of the housing 10.

A tubular transparent chimney 30 is provided for internal location within the tubular housing 10 so that the chimney 30 and the housing 10 can move in telescopic fashion relative to each other between a retracted position and an extended position. The candle holder 46 moves within the transparent tubular chimney 30. The chimney 30 is effectively sandwiched between the candle holder 46 and the housing 10.

The chimney 30 includes an upper ring 31 and a lower ring 32. The rings 31 and 32 are made of a high temperature resistant thermoplastic, namely a polyphenelyne. Such temperature is above about 200° C., and preferably 260° C. The particularly suitable product is that known as Ryton (Trademark of Philips Petroleum, obtainable from a division at Bartelsville, Okla.). The particular product is R4 which has a glass fiber content of about 30%. Each of the rings 31 and 32 are affixed to the respective upper end 33 and lower end 34 of the chimney 30 with a single component thixotropic paste suitable for high temperatures, above about 100° C. and preferably 140° C. The preferred adhesive is G757, a one-component epoxy produced by Emmerson & Cuming, a Grace Company of Wolburn, Mass.

The adhesive between the interengaging faces of the upper ring 31 and lower ring 32 relative to the opposite adjacent face portion of the upper portion 33 and lower portion 34 of the chimney is illustrated by numeral 50. A typical thixotropic paste is one which would withstand a temperature of at least about 100° C. and would preferably be 140° C.

The upper ring 31 includes a collar 35 inset from the outer periphery of the ring. Above the collar 35 can be located a heat shield 36 which has a top 37 and three spaced legs 38. The shield 36 is removable as required.

Two apertures 39 are provided diametrically spaced from each other for locating a foldable wire bail 40 for facilitating hanging of the lantern as required.

Figure 2:
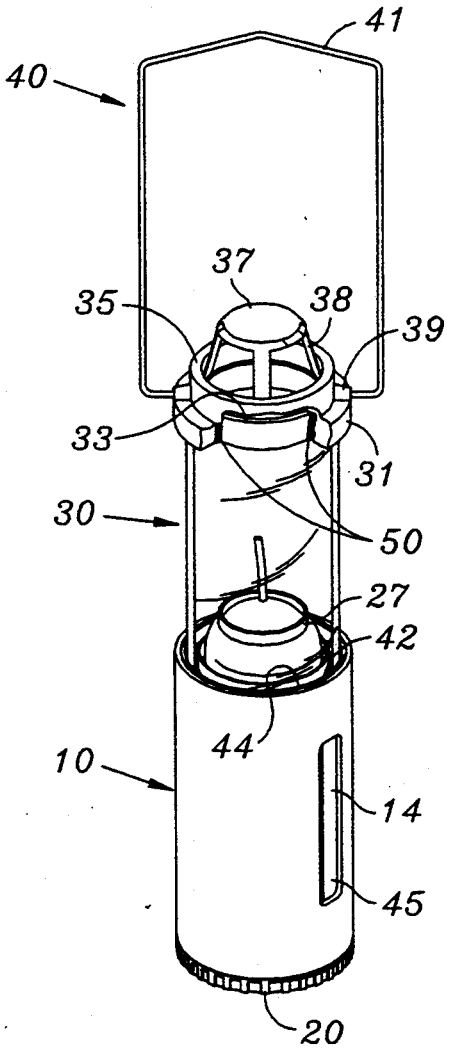
FIG. 2 is a perspective view of a lantern with the chimney extended, and part of an upper ring broken away.
Figure 3:
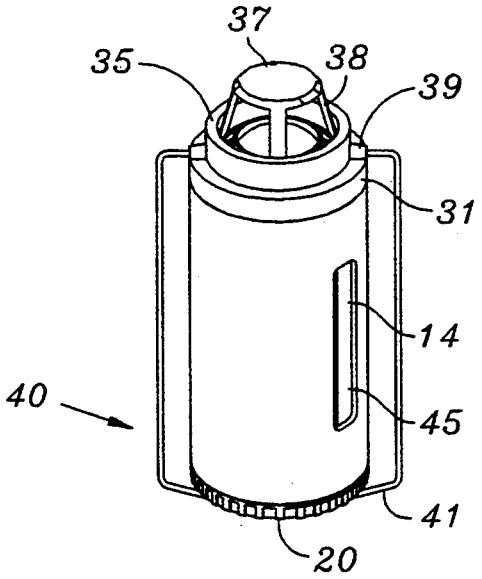
FIG. 3 is a perspective view of a lantern with the chimney retracted.
Figure 4:
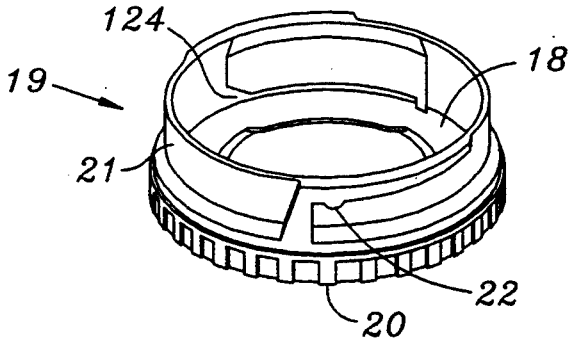
FIG. 4 is an enlarged perspective view of the base of the candle holder.

As illustrated in FIG. 1 and FIG. 2, the bail 40 is extended above the upper ring 31 such that hanging of the lantern can be effected. In the illustration of FIG. 3, the bail 40 is pivoted downwardly so that the transverse arm 41 of the bail 40 is located underneath the cap 20 at the foot of the candle holder 15. In this manner, the chimney 30 is retracted within the housing 10 and the bail 40 locks the lantern closed.

The transparent chimney 30 does not have any elongated elements extending between the upper ring 31 and the lower ring 32 for retaining the rings 31 and 32 in position with the chimney. There are no retaining elements across the transparent face of the chimney 30. There is no retaining element across the face of the chimney for securing the chimney 30 to the housing 10. The rings 31 and 32 are affixed solely with adhesive 50 to the respective ends of the glass of the chimney 30. In this manner, light imparted from the candle 14 and, in particular, the flame burning on wick 26 is unimpeded as it emanates from in the chimney 30 outwardly.

The lower ring 32 includes a slot 42 directed in an elongated fashion which is a guide for the elongated ridge 29 in the housing 10. Thus the chimney 30 can move upwardly and downwardly in the housing 10 with the slot 42 riding in the elongated ridge 29. To either side of the ridge 42 there is provided two seats 43 in protrusions 143. There are two pairs of diametrically opposed protrusions 143 with a pair of diametrically located spaces 60 between them. The seats 43 are accommodated in two spaced inwardly directed protrusions 44 which are located to either side of the elongated ridge 29 in the housing 10. Thus, a positive engagement of the lower ring 32 is made with the housing 10 when the seats 43 are secured in the protrusions 44 which are internally directed in the housing 10.

The lower ring 32 thus interlocks with the housing 10 to selectively permit removal, telescopic movement or locking of the chimney 30 with the housing 10 in a retracted or an extended position relative to the housing 10.

To effect extension of the chimney 30 from the housing 10, the following procedure is effected. The wire bail 40 is lined up with the side aperture 25 in the housing 10. At this stage, the slot 42 is lined up with the internal guide ridge 29 in the housing 10. The bail 40 is pulled upwardly thereby extending the chimney 30 in the housing 10. When the seats 43 engage in the protrusions 44, a firm extended position of the chimney 30 relative to the housing 10 is attained. When this is achieved, there is a definite audible and tactile "click".

Should the need arise to remove the glass chimney 30 entirely from the housing 10 of the lantern, this is effected by lining up the wire bail at 90 offset relative to the position in alignment with the aperture 29. The chimney 30 is in the lowered position. The chimney 30 is then pulled upwardly. This causes spaces 60 past the protrusions 44 inside the housing 10.

An additional locked position can be obtained by having a lowered glass chimney 30 located relative to the housing 10 with the wire bail 40 about half way between the side aperture 29 and the 90° offset position permitting separation of the chimney 30 from the housing 10.

Many other forms of the invention exist each differing from other in matters of detail only. For instance, instead of a candle construction being a light source, a suitable gas container and wick could be provided. Alternatively, instead of a collapsible lantern construction, it is possible to provide a permanently extended construction. A feature of the invention is the provision of a tempered glass chimney without restraining elements or retaining clips to secure the chimney in place with a housing to impede the light emanating from within the chimney.

The invention is to be determined solely in terms of the following claims.

We claim:

1. A lantern comprising a tubular housing having an upper end position and a lower end position, a light source in the housing, a tubular transparent chimney having opposite end portions, an upper ring and a lower ring located respectively about the chimney, the lower ring being for engagement with the upper end position of the housing, and there being no retaining elements across the transparent chimney.

2. A lantern as claimed in claim 1 wherein there is unimpeded transparency of the chimney between the respective rings.

3. A lantern as claimed in claim 1 wherein the lower ring interlocks with the housing thereby selectively permitting removal, telescopic movement, locking of the chimney with the housing in a retracted or extended position relative the housing.

4. A lantern as claimed in claim 1 wherein the rings are constituted by a temperature resistant thermoplastic polyphenelyne sulfide compound, such temperature being above about 200° C.

5. A lantern as claimed in claim 1 wherein the ring is adhesively connected with the chimney, the adhesive being a thixotropic paste suitable for temperatures above about 100° C.

6. A lantern as claimed in claim 4 wherein the ring is adhesively connected with the chimney, the adhesive being a thixotropic paste suitable for temperatures above about 100° C.

7. A collapsible lantern comprising a tubular housing having an upper end position and a lower end position, a light source in the housing, a tubular transparent chimney for telescopic movement within the housing, the chimney having opposite positions, an upper ring and a lower ring located respectively about the opposite ended positions, the lower ring being for a releasable engagement with the upper end position of the housing when the chimney is in an extended telescopic position, and for releasable engagement with the lower end portion when the chimney is in retracted telescopic position, a pivotable bail secured with the upper ring such that in a lower position with the chimney in the housing, the bail can lock the chimney with the housing, and in an upward position with the chimney extended from housing, the bail facilitates hanging of the lantern, the rings being connected respectively to the transparent chimney and there being no retaining elements across the transparent chimney.

8. A lantern as claimed in claim 7 wherein there is unimpeded transparency of the chimney between the respective rings.

9. A lantern as claimed in claim 7 wherein the lower ring interlocks with the housing thereby selectively permitting removal, telescopic movement, locking of the chimney with the housing in a retracted or extended position relative the housing.

10. A lantern as claimed in claim 9 wherein the chimney is relatively rotatable with the housing to effect the selective removal, telescopic movement, locking of the chimney in the retracted or extended positions.

11. A lantern as claimed in claim 7 wherein the rings are constituted by a temperature resistant thermoplastic polyphenelyne sulfide compound, such temperature being above about 200° C.

12. A lantern as claimed in claim 11 wherein the ring is adhesively connected with the chimney, the adhesive being a thixotropic paste suitable for temperatures above about 100° C.

13. A lantern as claimed in claim 7 wherein the ring is adhesively connected with the chimney, the adhesive being a thixotropic paste suitable for temperatures above about 100° C.

14. A collapsible lantern comprising a tubular housing having an upper end position and a lower end position, a light source in the housing, a tubular transparent chimney for telescopic movement within the housing, the chimney having opposite positions, an upper ring and a lower ring located respectively about the opposite ended positions, the lower ring being for a releasable engagement with the upper end position of the housing when the chimney is in an extended telescopic position, and for releasable engagement with the lower end portion when the chimney is in retracted telescopic position, a pivotable bail secured with the upper ring such that in a lower position with the chimney in the housing, the bail can lock the chimney with the housing, and in an upward position with the chimney extended from housing, the bail facilitates hanging of the lantern, the rings being affixed respectively solely with an adhesive to the respective ends of the chimney.

15. A lantern as claimed in claim 14 wherein there is unimpeded transparency of the chimney between the respective rings.

16. A lantern as claimed in claim 14 wherein the lower ring interlocks with the housing thereby selectively permitting removal, telescopic movement, locking of the chimney with the housing in a retracted or extended position relative the housing.

17. A lantern as claimed in claim 16 wherein the chimney is relatively rotatable with the housing to effect the selective removal, telescopic movement, locking of the chimney in the retracted or extended positions.

18. A lantern as claimed in claim 14 wherein the rings are constituted by a temperature resistant thermoplastic polyphenelyne sulfide compound, such temperature being above about 200° C.

19. A lantern as claimed in claim 18 wherein the ring is adhesively connected with the chimney, the adhesive being a thixotropic paste suitable for temperatures above about 100° C.

20. A lantern as claimed in claim 14 wherein the ring is adhesively connected with the chimney, the adhesive being a thixotropic paste suitable for temperatures above about 100° C.

21. A collapsible lantern comprising a tubular housing having an upper end position and a lower end position, a light source in the housing, a tubular transparent chimney having opposite end portions, ring means located with the chimney, the ring means being for engagement with the housing, there being no retaining elements across the transparent chimney for securing the chimney to the housing and wherein the ring means interlocks with the housing thereby selectively permitting removal, telescopic movement, and locking of the chimney with the housing in a retracted position or a extended position relative to the housing.

22. A collapsible lantern comprising a tubular housing having an upper end position and a lower end position, a light source in the housing, a tubular transparent chimney having opposite end portions, ring means located with the chimney, the ring means being for engagement with the housing, there being no retaining elements across the transparent chimney for securing the chimney to the housing, and wherein the chimney is relatively rotatable with the housing to effect the selective removal, telescopic movement, and locating of the chimney in a retracted position or an extended position relative to the housing.

* * * * *